US006491009B1

(12) United States Patent
Schmaler et al.

(10) Patent No.: US 6,491,009 B1
(45) Date of Patent: Dec. 10, 2002

(54) METHOD OF CONTROLLING A DEVICE FOR VARYING THE VALVE CONTROL TIMES OF AN INTERNAL COMBUSTION ENGINE, ESPECIALLY A CAMSHAFT ADJUSTMENT DEVICE WITH A HYDRAULICALY RELEASABLE START LOCKING SYSTEM

(75) Inventors: Jens Schmaler, Herzogenaurach (DE); Rainer Ottersbach, Bonn (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 10/019,555

(22) PCT Filed: May 27, 2000

(86) PCT No.: PCT/EP00/04844

§ 371 (c)(1),
(2), (4) Date: Jan. 9, 2002

(87) PCT Pub. No.: WO01/02703

PCT Pub. Date: Jan. 11, 2001

(30) Foreign Application Priority Data

Jun. 26, 1999 (DE) ..... 199 29 394

(51) Int. Cl.[7] ..... F01L 1/344
(52) U.S. Cl. ..... 123/90.17
(58) Field of Search ..... 123/90.15, 90.17, 123/90.31

(56) References Cited

U.S. PATENT DOCUMENTS 5,816,204 A * 10/1998 Moriya et al. ..... 123/90.17
6,006,708 A * 12/1999 Ken et al. ..... 123/90.17

FOREIGN PATENT DOCUMENTS

DE 19726300 1/1998
DE 19834188 2/1999
DE 19819360 6/1999
EP 0808997 11/1997

OTHER PUBLICATIONS

Patent Abstracts of Japan (1 page), Toyota Motor Corp. Publ. No. 10148108, Publ. Date: Jun. 2, 1998.

* cited by examiner

*Primary Examiner*—Weilun Lo
(74) *Attorney, Agent, or Firm*—Bierman, Muserlian and Lucas

(57) ABSTRACT

The invention concerns a method of actuating a device for varying the valve timing of an internal combustion engine, said device comprising an element fixed to the camshaft and an element fixed to the crankshaft, which elements are in power-transmitting relationship with each other through at least one hydraulic working chamber formed within the device. When the internal combustion engine has been switched off, the element fixed to the camshaft can be mechanically coupled by a locking element to the element fixed to the crankshaft in a preferred basic position for starting the internal combustion engine. According to the invention, to avoid a jamming of the locking element during starting of the internal combustion engine, the solenoid of the hydraulic valve is at first subjected to a sudden energization with a current of an intensity lower that that required for the central position of the valve piston of the hydraulic valve. Following this, the energization is gradually increased to a current intensity higher than that required for the central position of the valve piston. If the microprocessor now determines that the element fixed to the camshaft is still in its basic position, the first two phases are repeated, and when the microprocessor determines an angular displacement of the element fixed to the camshaft out of its basic position, the solenoid is again subjected to a sudden energization with a current defined by the microprocessor and corresponding to an adjusted angular position of the camshaft relative to the crankshaft.

3 Claims, 3 Drawing Sheets

METHOD OF CONTROLLING A DEVICE FOR VARYING THE VALVE CONTROL TIMES OF AN INTERNAL COMBUSTION ENGINE, ESPECIALLY A CAMSHAFT ADJUSTMENT DEVICE WITH A HYDRAULICALY RELEASABLE START LOCKING SYSTEM

FIELD OF THE INVENTION

The invention concerns a method of actuating a device for varying the valve timing of an internal combustion engine, which method can be advantageously implemented particularly in a camshaft adjusting device having a hydraulically releasable start locking.

BACKGROUND OF THE INVENTION

Such a method relates particularly to camshaft adjusting devices of the generic type disclosed in DE-OS 197 26 300. These devices, generally designated in the technical field as axial piston or rotary piston adjusting devices, are generally configured as hydraulic adjusting drives that comprise an element fixed in driving relationship to the crankshaft of the internal combustion engine and an element rotationally fixed to the camshaft. The element fixed to the crankshaft is in power-transmitting relationship with the element fixed to the camshaft through at least one hydraulic working chamber configured within the device, each hydraulic working chamber being divided by an adjusting element within the device into a so-called A pressure chamber and a B pressure chamber. A pivoting or fixing of the element fixed to the camshaft relative to the element fixed to the crankshaft is effected by a selective or a simultaneous pressurizing of the A and/or B pressure chamber of each hydraulic working chamber, the pressurizing of the pressure chambers being controlled by an electromagnetically actuated valve piston of a hydraulic valve whose solenoid is actuated by a microprocessor as a function of different operation parameters of the internal combustion engine. Normally, this valve piston of the hydraulic valve permits, in a non-energized or low energized state of the solenoid, a pressurization of the B pressure chamber of each hydraulic working chamber, in a high or maximum energized state of the solenoid, a pressurization of the A pressure chamber of each hydraulic working chamber, and in a central position, a holding of the pressure medium pressure in both pressure chambers of each hydraulic working chamber of the device. When the internal combustion engine has been switched off and the volume of the A pressure chamber of each hydraulic working chamber is minimized, the element fixed to the camshaft can be mechanically coupled to the element fixed to the crankshaft in a preferred basic position for starting the internal combustion engine, coupling be achieved by an additional locking element arranged on the element fixed to the camshaft or on the element fixed to the crankshaft, which locking element can be displaced by a spring element into a coupling position within a complementary reception in the element fixed to the crankshaft or in the element fixed to the camshaft. This complementary reception of the locking element is hydraulically connected to the pressure medium supply to the volume-minimized A pressure chamber of at least one hydraulic working chamber of the device, so that, upon pressurization of the volume-minimized A pressure chamber of each hydraulic working chamber during starting of the internal combustion engine, the reception of the locking element is likewise pressurized and the locking element is displaced hydraulically, against the force of its spring element, into an uncoupling position.

This shock-like pressurization of the volume-minimized A pressure chamber generally effected by a maximum energization of the solenoid has proved to be a drawback in practice because the sudden rise of pressure in all the volume-minimized A pressure chambers causes a bracing moment to act on the locking element which leads to a jamming of the locking element in its coupling position particularly when the mean moment of drag of the camshaft acts in the same direction as the bracing moment and/or when the time for building up the bracing moment is shorter than the time for displacing the locking element into its uncoupling position. As a consequence, a relative rotation between the element fixed to the camshaft and the element fixed to the crankshaft through a defined angle given by the microprocessor is no longer possible, so that, for example, in the case of inlet-side camshaft adjusting devices there are performance deficits of the internal combustion engine, and in the case of outlet-side camshaft adjusting devices, the internal combustion engine has higher emission values.

OBJECT OF THE INVENTION

The object of the invention is therefore to provide a method of actuating a device for varying the valve timing of an internal combustion engine, particularly a camshaft adjusting device having a hydraulically releasable start locking, which method enables a reliable prevention of a jamming of the locking element in its coupling position even when a bracing moment resulting from a pressurization and a mean moment of drag of the camshaft impede movement of the locking element in the same direction.

SUMMARY OF THE INVENTION

The invention achieves this object in a device by the fact that the solenoid of the hydraulic valve is operated on starting of the internal combustion engine following a method of actuation of the instant invention.

According to this actuating method of the invention, the solenoid of the hydraulic valve is at first subjected, for a defined period of time, to a sudden energization with a current of an intensity lower than that required for the central position of the valve piston of the hydraulic valve, so that, to begin with, only the B pressure chamber of each hydraulic working chamber of the device is pressurized with a pressure medium pressure by which the element fixed to the camshaft is held hydraulically in its basic position. This is followed, during a further defined period of time, by a gradual increase of the energization of the solenoid to a current intensity that is higher than that required for the central position of the valve piston of the hydraulic valve, so that, when the central position of the valve piston has been passed, even the volume-minimized A pressure chamber of each hydraulic working chamber of the device, and thus also the reception of the locking element is pressurized with a pressure medium pressure. During the time of gradual increase of energization, or if desired, even following this, the microprocessor checks whether the element fixed to the camshaft has been angularly displaced relative to the element fixed to the crankshaft out of its basic position and the locking element has therefore taken its uncoupling position. If the microprocessor determines that the element fixed to the camshaft is still in its basic position, that is to say that the locking element has remained in its coupling position, the routine consisting of the sudden energization, the gradual increase of current intensity and the position check by the microprocessor is broken off and the routine is repeated till the microprocessor registers that the element fixed to the camshaft has been angularly displaced relative to the element fixed to the crankshaft out of its basic position and, thus, that the locking element has come into its uncoupling position. When such an angular displacement of the element fixed to the camshaft has been determined by the microprocessor, the routine is likewise broken off and, as a last step, the solenoid of the hydraulic valve is energized with a current defined by the microprocessor that is required for reaching or maintaining an adjusted angular position of the element fixed to the camshaft relative to the element fixed to the crankshaft.

According to an advantageous feature of the invention, it is proposed to actuate the solenoid of the hydraulic valve preferably with a pulse width modulated voltage control so that the energization of the solenoid at the start of the internal combustion engine preferably begins with a sudden rise from 0% to 5% below the intensity required for the central position of the valve piston of the hydraulic valve and, for passing the central position of the valve piston, is then raised relatively slowly from 5% below to 5% above the intensity required for the central position of the valve piston of the hydraulic valve. When an angular displacement of the element fixed to camshaft out of its basic position has been determined by the microprocessor, the pulse width modulated voltage control is set preferably so that the energization of the solenoid of the hydraulic valve again increases suddenly to a value between 5% above the intensity required for the central position of the valve piston of the hydraulic valve and 100% of the maximum intensity, depending on which adjusted angular position of the element fixed to the camshaft relative to the element fixed to the crankshaft is to be reached next. However, in place of a pulse width modulated voltage control with this setting, it is also possible to realize the energization of the solenoid with a current regulation of a type, known per se.

According to a further feature of the method of the invention, it is finally proposed that the sudden actuation of the solenoid of the hydraulic valve both before and after passing of the central position of the valve piston of the hydraulic valve should be effected in a time period of between 5 ms and 10 ms, while the phase of passing the central position of the valve piston of the hydraulic valve is preferably limited to a time period in the range of 100 ms to 300 ms. It has been determined in practice that, in most cases, the locking element reliably takes its uncoupling position already after one, or at the latest after two completed routines and any desired adjusted angular position between the crankshaft and the camshaft of the internal combustion engine can be realized. The purpose of the brief pressurization of the B pressure chamber of each hydraulic working chamber at the beginning of the routine is to bring the element fixed to the camshaft that, due to the moment of drag of the camshaft, has been rotated through an angle (up to 1° crankshaft angle) corresponding to the operational play of movement of the locking element and that may be jamming the locking element, back into a position in which the locking element can move freely for the following pressurization of the A pressure chamber of each hydraulic working chamber of the device.

The method of the invention for actuating a device for varying the valve timing of an internal combustion engine, particularly a camshaft adjusting device having a hydraulically releasable start locking thus permits, in contrast to prior art actuating methods for devices of a similar type, a reliable prevention of a jamming of the locking element in its coupling position during the starting of the internal combustion engine even when a bracing moment resulting from the pressurization of the volume-minimized A pressure chamber of each hydraulic working chamber of the device and a mean moment of drag of the camshaft impede movement of the locking element in the same direction. The energization of the solenoid of the hydraulic valve according to the invention comprising an initial brief pressurization. of the B pressure chamber of each hydraulic working chamber followed by a slow passing of the central position of the valve piston of the hydraulic valve and the pressurization of the A pressure chamber of each hydraulic working chamber guarantees a reliable movement of the locking element into its uncoupling position and, thus also, a reliable releasing of the start locking of the device. In this way, already immediately after the starting of the internal combustion engine, relative rotations between the element fixed to the camshaft and the element fixed to the crankshaft into defined angular positions given by the microprocessor are possible, and negative consequences such as reduced performance or increased emission of the internal combustion engine are excluded.

BRIEF DESCRIPTION OF THE DRAWINGS

The method according to the invention will now be described more closely with reference to an example of embodiment and the appended drawings.

DETAILED DESCRIPTION OF THE INVENTION

Figure 1:
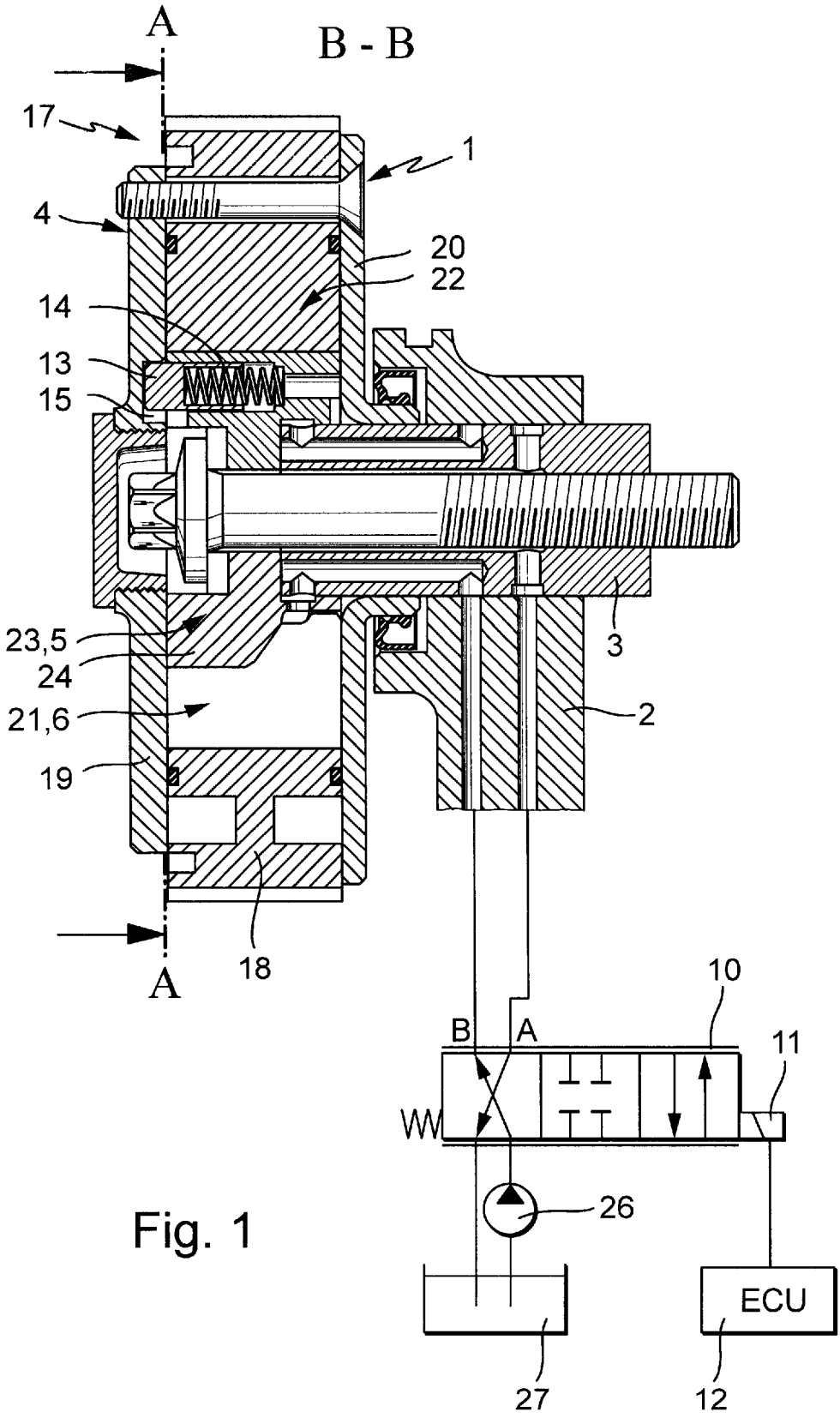
FIG. 1 shows a cross-section taken along line B—B of FIG. 2 through a camshaft adjusting device mounted on a camshaft, with a schematic representation of pressure medium control.
Figure 2:
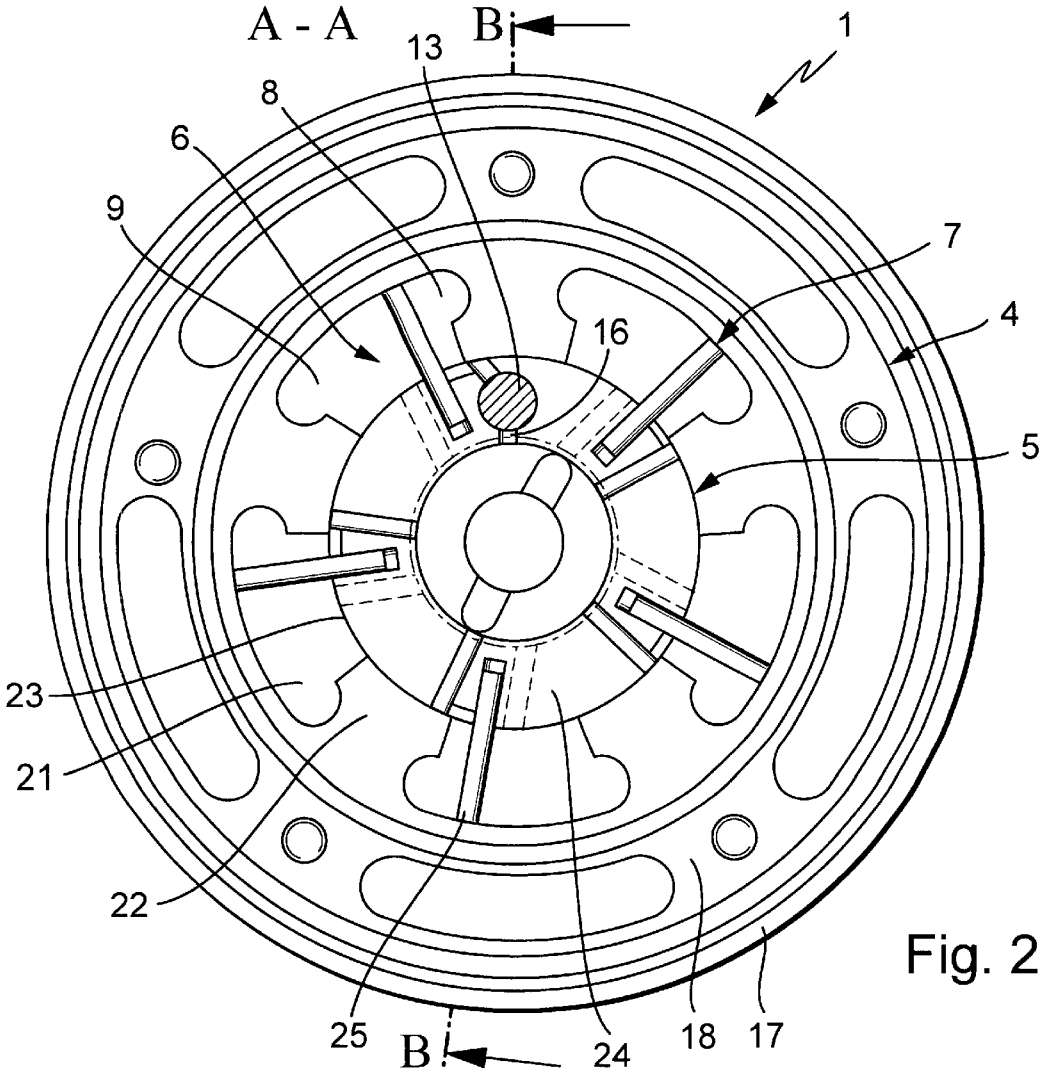
FIG. 2 is a top view of a camshaft adjusting device corresponding to section A—A of FIG. 1.

FIGS. 1 and 2 show a device 1 for varying the valve timing of an internal combustion engine with reference to which the method of the invention will be described by way of example. The device 1 belongs to the so-called rotary piston devices and is designated as a vane-type adjuster. This device 1, as also the so-called axial piston devices, is generally configured as a hydraulic adjusting drive and is arranged on the drive-side end of a camshaft 3 mounted in the cylinder head 2 of the internal combustion engine. The device 1 comprises, in a known manner, an element 4 fixed to the crankshaft of the internal combustion engine in driving relationship with the crankshaft, and an element 5 rotationally fixed to the camshaft 3, said elements 4, 5 being in power-transmitting relationship through at least one hydraulic working chamber 6 formed within the device 1. As can be seen in FIGS. 1 and 2, the element 4 fixed to the crankshaft is formed by a drive pinion 17 configured as an outer rotor which comprises a hollow space 21 defined by a hollow cylindrical circumferential wall 18 and two side walls 19, 20. In the present example, five hydraulic working chambers 6 are formed in the hollow space 21 by five limiting walls 22 extending from the circumferential wall 18 towards the central longitudinal axis of the device 1. The element 5 fixed to the camshaft is formed by a rotor 23 that is inserted into the hollow space 21 of the drive pinion 17 and comprises five vanes 25 arranged on its hub 24, each vane 25 extending radially into one of the hydraulic working chambers 6. The vanes of this rotor 23, that is configured as an adjusting element 7 within the device 1, divide each hydraulic working chamber 6 of the device 1 into an A pressure chamber and a B pressure chamber, which chambers, upon a selective or a simultaneous pressurization by a hydraulic pressure medium effect a pivoting or a fixing of the rotor 23 relative to the drive pinion 17 and, thus, of the camshaft 3 relative to the crankshaft of the internal combustion engine. The pressurization of the A and/or B pressure chamber of each hydraulic working chamber 6 is regulated by the electromagnetically actuated valve piston of a hydraulic valve 10, schematically represented in FIG. 1, whose solenoid 11 is actuated as a function of different operation parameters of the internal combustion engine by a microprocessor 12, also represented only schematically in FIG. 1. The hydraulic valve 10, configured as a 4/3 directional control valve, is connected to a pressure medium pump 26 and a pressure medium reservoir 27 and enables, in the position of its valve piston shown in FIG. 1 which corresponds to a non-energized or low energized solenoid 11, a pressurization of the B pressure chamber 9, in the position of its valve piston corresponding to a high or maximum energized solenoid 11, a pressurization of the A pressure chamber 8, and in a central position of its valve piston, a holding of the pressure medium pressure in both pressure chambers 8, 9 of each hydraulic working chamber 6 of the device 1.

A further feature of the device 1 shown in FIGS. 1 and 2 is that, after the internal combustion engine has been switched off accompanied by a volume minimization of the A pressure chambers 8 of the hydraulic working chambers 6, the element 5 fixed to the camshaft and configured as a rotor 23 can be coupled mechanically to the element 4 fixed to the crankshaft and configured as a drive pinion 17 in a preferred basic position for starting the internal combustion engine. Depending on whether the device 1 adjusts an inlet or an outlet camshaft, this basic position corresponds to a "retard" or an "advance" position of the camshaft 3 relative to the crankshaft which is reached when the vanes 25 of the rotor 23 come into an end position on one or the other of the limiting walls 22 of each hydraulic working chamber 6. FIG. 2 shows a device 1 connected to an outlet camshaft with the rotor 23 rotated almost into the basic i.e., "advance" position. As best seen in FIG. 1, the mechanical coupling is effected by a pin-like locking element 13 arranged for displacement in an axial bore, not referenced, in the hub 24 of the rotor 23. This locking element 13 can be displaced by a spring element 14 into a coupling position, corresponding to that shown in FIG. 1, within a complementary reception 15 in the side wall 19 of the drive pinion 17. FIG. 2 further shows that the complementary reception 15 of the locking element 13 is arranged within the pressure medium supply 16 to a volume-minimized A pressure chamber 8 of a hydraulic working chamber 6 of the device 1, so that, when the internal combustion engine is started, the pressurization of the A pressure chambers of the hydraulic working chambers 6 results in a simultaneous pressurization of the reception 15 of the locking element 13 which is then displaced hydraulically, against the force of its spring element 14, into its uncoupling position in the axial bore in the hub 24 of the rotor 23.

Figure 3:
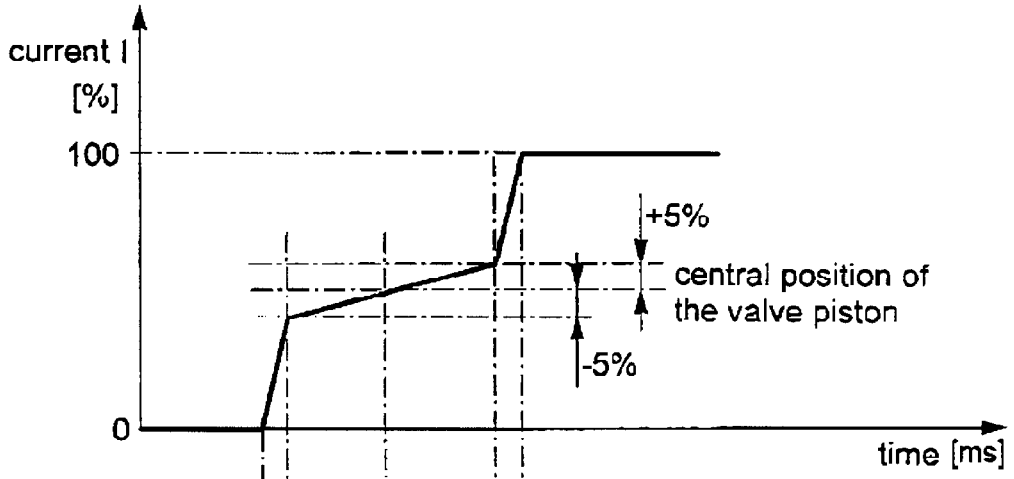
FIG. 3 is a current-time diagram showing the flow of current in the solenoid of the hydraulic valve, according to the method of the invention.
Figure 4:
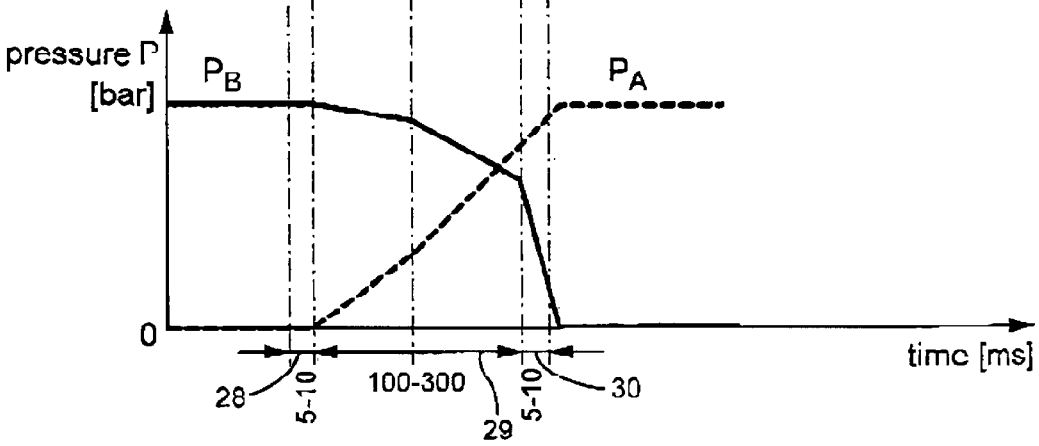
FIG. 4 is a pressure-time diagram showing the flow of pressure in the A and the B pressure chambers of each hydraulic working chamber of the device, according to the method of the invention.

To avoid a bracing moment acting on the locking element 13 due to a sudden pressurization of the volume-minimized A pressure chambers 8 of the hydraulic pressure chambers 6 on starting of the internal combustion engine, which bracing moment together with a mean moment of drag of the camshaft 3 possibly also acting in the same direction, causes a jamming of the locking element 13 in its coupling position, the solenoid 11 of the hydraulic valve 10 is operated according to a regulation strategy, provided by the invention and graphically represented in diagrams in FIGS. 3 and 4, to assure a jam-free movement of the locking element 13 into its uncoupling position. These diagrams show that on starting of the internal combustion engine, the solenoid 11 of the hydraulic valve 10 is energized with a current I in a first phase 28 for a time period t of 5 ms to 10 ms suddenly from 0% to 5% below the intensity required for the central position of the valve piston of the hydraulic valve 10, so that, at first, only the B pressure chambers of the hydraulic working chambers 6 of the device 1 are pressurized with a pressure medium pressure $P_B$ corresponding to the solid-line pressure curve in FIG. 4 with which the rotor 23 is held hydraulically in its basic position. In a second phase 29, during a time period t between 100 ms and 300 ms, the current I is gradually increased to an intensity from 5% below to 5% above the intensity required for the central position of the valve piston of the hydraulic valve 10, so that after the central position of the valve piston has been passed, the volume-minimized A pressure chambers 8 of the hydraulic working chambers 6 of the device 1 and, thus also, the reception 15 of the locking element 13 are likewise pressurized with a pressure medium pressure $P_A$ corresponding to the broken-line pressure curve shown in FIG. 4. During this gradual increase of the current I, the microprocessor 12 continuously checks whether the rotor 23 has been angularly displaced relative to the drive pinion 17 out of its basic position. If the microprocessor 12 determines that the basic position of the rotor 23 has remained unchanged, the routine is broken off at the latest at the end of the maximum time period of 300 ms set for the gradual increase of the current I. This is followed by a repetition of the first and the second phase 28, 29 of energization of the solenoid 11 with current I till the microprocessor 12 determines an angular displacement of the rotor 23 relative to the drive pinion 17 out of its basic position and thus registers that the locking element 13 has taken its uncoupling position. When such an angular displacement of the rotor 23 out of its basic position has been determined by the microprocessor 12, which can be the case after a number of routines have been performed, or as represented in FIGS. 3 and 4, already after performance of the first routine, the routine is likewise broken off and the solenoid 11 of the hydraulic valve 10 is again subjected, in a third phase lasting a time period t of 5 ms to 10 ms, to a sudden energization with a current I, in the present case, of 100% of the maximum intensity.

REFERENCE NUMERALS

1 Device
2 Cylinder head
3 Camshaft
4 Element fixed to crankshaft
5 Element fixed to camshaft
6 Hydraulic working chamber
7 Adjusting element
8 A pressure chamber
9 B pressure chamber
10 Hydraulic valve
11 Solenoid
12 Microprocessor
13 Locking element

14 Spring element
15 Reception
16 Pressure medium supply
17 Drive pinion
18 Circumferential wall
19 Side wall
20 Side wall
21 Hollow space
22 Limiting wall
23 Rotor
24 Hub
25 Vane
26 Pressure medium pump
27 Pressure medium reservoir
28 First phase
29 Second phase
30 Third phase
I Current
t Time period
P Pressure medium pressure
$P_A$ Pressure medium pressure in A pressure chamber
$P_B$ Pressure medium pressure in B pressure chamber

What is claimed is:

1. A method of actuating a camshaft adjusting device having a hydraulically releasable start locking for varying the valve timing of an internal combustion engine, said device generally comprising following features:

the device (1) is generally configured as a hydraulic adjusting drive comprising an element (4) fixed in driving relationship to a crankshaft of the internal combustion engine and an element (5) rotationally fixed to the camshaft (3), the element (4) fixed to the crankshaft is in power-transmitting relationship with the element (5) fixed to the camshaft through at least one hydraulic working chamber (6) formed within the device (1), each hydraulic working chamber (6) is divided by an adjusting element (7) within the device (1) into an A pressure chamber (8) and a B pressure chamber (9), a pivoting or fixing of the element (5) fixed to the camshaft relative to the element (4) fixed to the crankshaft is effected by a selective or a simultaneous pressurizing of the A and/or B pressure chamber (8, 9) of each hydraulic working chamber (6), the pressurizing of the A and/or B pressure chamber (8, 9) of each hydraulic working chamber (6) is controlled by an electromagnetically actuated valve piston of a hydraulic valve (10) whose solenoid (11) is actuated by a microprocessor (12) as a function of different operation parameters of the internal combustion engine, the valve piston of the hydraulic valve (10) permits, in a non-energized or low energized state of the solenoid (11), a pressurization of the B pressure chamber (8), in a high or maximum energized state of the solenoid (11), a pressurization of the A pressure chamber (9), and in a central position, a holding of the pressure medium pressure (P) in both pressure chambers (8, 9) of each hydraulic working chamber (6) of the device (1), when the internal combustion engine has been switched off and the volume of the A pressure chamber (8) of each hydraulic working chamber (6) has been minimized, the element (5) fixed to the camshaft can be mechanically coupled to the element (4) fixed to the crankshaft in a preferred basic position for starting the internal combustion engine, the mechanical coupling is achieved by a locking element (13) arranged on the element (5) fixed to the camshaft or on the element (4) fixed to the crankshaft, which locking element (13) can be displaced by a spring element (14) into a coupling position within a complementary reception (15) in the element (4) fixed to the crankshaft or in the element (5) fixed to the camshaft, the complementary reception (15) of the locking element (13) is hydraulically connected to a pressure medium supply (16) to a volume-minimized A pressure chamber (8) of at least one hydraulic working chamber (6) of the device (1), upon pressurization of the volume-minimized A pressure chamber (8) of each hydraulic working chamber (6) during starting of the internal combustion engine, the reception (15) of the locking element (13) is likewise pressurized and the locking element (13) is displaced hydraulically, against the force of its spring element (14), into an uncoupling position, characterized in that, to achieve a jam-free displacement of the locking element (13) into its uncoupling position, the solenoid (11) of the hydraulic valve (10) is energized during starting of the internal combustion engine using following regulation strategy:

a) sudden energization during a defined time period (t) with a current (I) having an intensity below that required for the central position of the valve piston of the hydraulic valve (10), so that, at first, only the B pressure chamber (9) of each hydraulic working chamber (6) of the device (1) is pressurized with a pressure medium pressure ($P_B$) by which the element (5) fixed to the camshaft is held hydraulically in its basic position, b) gradual increase of the current (I) during a further defined time period (t) to an intensity above that required for the central position of the valve piston of the hydraulic valve (10), so that, after the central position of the valve piston has been passed, even the volume-minimized A pressure chamber (8) of each hydraulic working chamber (6) of the device (1) and thus also the reception (15) of the locking element (13) are pressurized with a pressure medium pressure ($P_A$), c) during the time period (t) of gradual increase of the current (I), or directly following this time period, a check by the microprocessor (12) to determine whether the element (5) fixed to the camshaft has been angularly displaced relative to the element (4) fixed to crankshaft out of its basic position and the locking element (13) has therefore taken its uncoupling position, d) in case of determination by the microprocessor (12) that the element (5) fixed to the camshaft is still in the basic position, breaking-off of the routine and repetition of steps a) to c) till the microprocessor (12) registers that the element (5) fixed to the camshaft has been angularly displaced relative to the element (4) fixed to the crankshaft out of its basic position and that, therefore, the locking element (13) has taken its uncoupling position, e) after determination of an angular displacement of the element (5) fixed to the camshaft out of its basic position, breaking-off of the routine and sudden energization with a current (I) pre-defined by the microprocessor (12) to correspond to an adjusted angular position of the element (5) fixed to the camshaft relative to the element (4) fixed to the crankshaft.

2. A method according to claim 1, characterized in that the solenoid (11) of the hydraulic valve (10) is actuated by a pulse width modulated control voltage so that the energization of the solenoid (11) with current (I) during starting of the internal combustion engine is as follows:

at the beginning of actuation, sudden rise of energization from 0% to 5% below the intensity required for the central position of the valve piston of the hydraulic valve (10), during passing of the central position of the valve piston, energization from 5% below to 5% above the intensity required for the central position of the valve piston of the hydraulic valve (10), and after determination of an angular displacement of the element (5) fixed to the camshaft out of its basic position, further sudden energization to a level between 5% above the intensity required for the central position of the valve piston of the hydraulic valve (10) and 100% of the maximum intensity.

3. A method according to claim 1, characterized in that the sudden energization of the solenoid (11) of the hydraulic valve (10) both before and after the passing of the central position of the valve piston of the hydraulic valve (10) is effected in a time period (t) of between 5 ms and 10 ms, while the passing of the central position of the valve piston of the hydraulic valve (10) is limited to a time period (t) between 100 ms and 300 ms.

* * * * *